United States Patent [19]

Stringer et al.

[11] Patent Number: 4,875,580

[45] Date of Patent: Oct. 24, 1989

[54] COMPRESSOR SHIPPING PACKAGE

[75] Inventors: Hugh C. Stringer, Bristol; Larry D. Montgomery, Glade Spring, both of Va.

[73] Assignee: Bristol Compressors, Inc., Bristol, Va.

[21] Appl. No.: 312,869

[22] Filed: Feb. 21, 1989

[51] Int. Cl.[4] ..... B65D 85/62; B65D 81/02

[52] U.S. Cl. ..... 206/319; 206/485; 206/497; 206/585; 206/597

[58] Field of Search ..... 206/585, 587, 588, 589, 206/319, 320, 488, 489, 485

[56] References Cited

U.S. PATENT DOCUMENTS

| | | | |
|---|---|---|---|
| 2,477,512 | 7/1949 | Dunneback | 206/319 |
| 3,217,875 | 11/1965 | Scheibel | 206/488 X |
| 4,027,794 | 6/1977 | Olson | 206/485 X |
| 4,303,157 | 12/1981 | Edwards | 206/485 X |
| 4,391,371 | 7/1983 | Sieffert | 206/489 X |

FOREIGN PATENT DOCUMENTS

| | | | |
|---|---|---|---|
| 501938 | 4/1974 | U.S.S.R. | 206/319 |

*Primary Examiner*—William Price

[57] ABSTRACT

A shipping package for individual product units such as compressors or the like, adapted for use with a substantially planar shipping pallet, the package having a base pad and at least one middle pad, each of which pads has a substantially planar corrugated board member having one or more upper and lower plies, at least one of the upper plies having a plurality of individual cut-outs opening at the top surface of the board member, each cut-out being shaped to receive lower portions of an individual product unit in a substantially confining manner for preventing lateral movement thereof, each middle pad having strengthening walls peripherally surrounding the board member and oriented normal to the plane thereof, the walls extending a substantial distance on each side of the plane for maintaining the planar character of the member against substantial distortion forces, a plurality of units positioned on each pad in the cut-outs with each middle pad poisitioned on the tops of underlying units, and a cap overlying the uppermost plurality of product units.

7 Claims, 5 Drawing Sheets

COMPRESSOR SHIPPING PACKAGE

This invention concerns shipping and/or inventory packaging for multiple items of machinery or other devices which must be maintained isolated from each other during shipping in order to prevent damage thereto, and particularly concerns such bulk packaging for multiple refrigeration compressor shipping.

In the design of bulk packaging for such items as refrigeration compressors for shipment, particularly as supported on shipping pallets, many structural and economic factors must be taken into consideration and include the following features and concerns:

- reduce the package weight and require minimum dimensions;
- increase total number of units per pallet;
- reduce cost per unit for shipping;
- use re-cyclable components;
- reduce required inventory floor space;
- reduce the space between the units while maintaining positive isolation;
- accurate placement and alignment of compressors for component protection and package strength;
- standarization of package components to reduce inventory;
- achieve maximum strength of package components to maximize product protection; and
- arrangement of package components separating top and bottom layers to reduce handling damage and eliminate need for stronger structural members such as plywood or the like.

Heretofore the packaging of compressors has utilized lightweight corrugated board (U.S. Pat. No. 4,391,371, the disclosure of which is incorporated herein by reference), foamed plastic material, and even plywood. The foamed plastic material represents an expensive, preformed material of substantial bulk requiring excessive shipping and storage space, and also comprises chemical material not easily disposed of or recycled. The use of plywood as shown in U.S. Pat. No. 3,217,875 presents problems in weight addition and in conforming it to the various shapes of compressors, e.g., the bottom and feet patterns, and also is of excessive weight and expense. Corrugated board is a preferred material for such packaging, however, its use for the packaging of such items as compressors has not been of an effective nature due to the structures, regarding both configuration and engineering, into which it has been formed for packaging.

Principal objectives of the present therefore, are to provide bulk packaging for compressors or the like wherein all of the aforementioned features and concerns are accommodated with a minimum of expense.

These and other objectives hereinafter becoming evident have been attained in accordance with the present invention which is broadly defined as a shipping package for individual product units such as compressors or the like, adapted for use with a substantially planar shipping pallet, said package comprising base pad means and at least one middle pad means, each of which pad means has a substantially planar corrugated board member having one or more upper and lower plies, at least one of said upper plies having a plurality of individual cut-outs opening at the top surface of said member, each cut-out being shaped to receive lower portions of an individual product unit in a substantially confining manner for preventing lateral movement thereof, each said middle pad means having strengthening wall means peripherally surrounding said board member and oriented normal to the plane thereof, said wall means extending a substantial distance on each side of said plane for maintaining the planar character of said member against substantial distortion forces, a plurality of units positioned on each said pad means in said cut-outs with each said middle pad means positioned on the tops of underlying units, and cap means overlying the uppermost plurality of product units.

In certain preferred embodiments:

(a) the base pad means is positioned flat on a shipping pallet, and strap means is wrapped around the package and pallet to effect a tightly bound shipping unit comprising said pallet, pad means, product units and cap means;

(b) the package is tightly radially, peripherally wrapped with plastic sheeting;

(c) said cap means is formed of corrugated board having a planar body and strengthening walls integral with and surrounding the periphery thereof and extending downwardly therefrom; and (d) each said middle pad means comprises an assembly of two equivalent tray structures in back-to-back arrangement, and having an equivalent structure of said base pad means nested in the upper portion of each middle pad means assembly with the cut-outs facing upwardly.

The invention will be further understood from the following description and drawings wherein.

Figure 1:
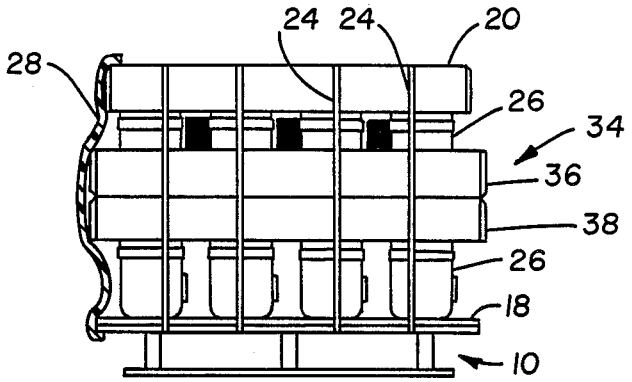
FIG. 1 is an end view of the package with double layered compressors in position.

Referring to the drawings, FIG. 1 shows the packaged compressors stacked in two layers, although several such stackings can be employed. The package preferably employs a typical wooden pallet generally designated 10 having base slats 12, risers 14, and top slats 16. This structure represents conventional fork-lift type pallets which are preferred for the present package, however pallets of different construction may be employed without significant alteration of the present invention.

The package has a base pad means 18 adapted to lie flat on the pallet, a cap 20 adapted to overlie the uppermost layer of compressors and rest on their tops, and middle pad means 34. A plurality of steel, fabric or plastic bands such as 24 surround the package components and tightly bind the pallet, base pad, middle pad means, cap and compressors 26 together to form a shipping package. This package, in a preferred embodiment is further bound and protected against moisture, dust and the like by plastic sheeting, e.g., 4–6 mil, of clear or colored polyethylene, polypropylene, polyester or the like covering 28 as shown in FIG. 1 in cross-section (on one side) in exaggerated thickness for clarity. This covering may be tightly wound radially around the package in several strengthening layers and also may be of a plastic composition that can be heated prior to applying it so as to shrink onto the package as it cools. The covering can also be extended over the top of the cap 20 if desired.

Figure 6:
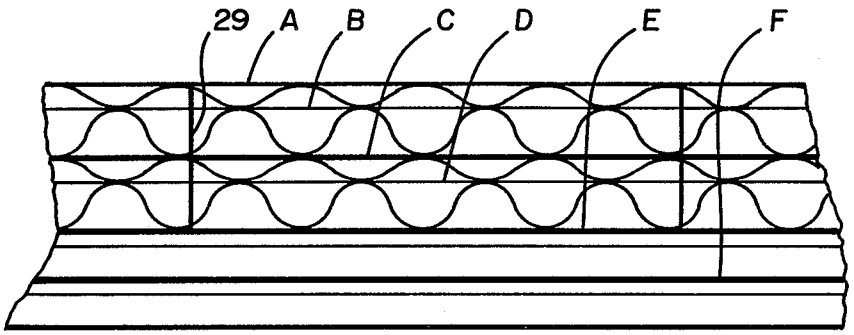
FIG. 6 is a cross-sectional view of a cut-out portion of the corrugated paperboard pad taken along line 6—6 of FIG. 5 in the direction of the arrows with thickness dimensions enlarged for clarity.

Referring to the drawings, the base pad means 18 is of special construction and comprises, in the form employed as the pad which lies on top of the pallet, a multi-layered or multi-ply corrugated board wherein at least the top ply has been die stamped or the like to provide the cut-outs 29. These cut-outs are dimensioned to receive the mounting feet 30 and bottom portion 32 of the compressor shell and may of course be varied to accommodate differently shaped or sized compressors. These cut-outs provide a positive means for preventing lateral movement of the compressor during shipment. Such construction can be achieved by separately forming this top ply, e.g., by die stamping, and then adhesively securing it to the underlying corrugated plies in the normal course of corrugated board manufacture. It is preferred that this base pad have the corrugated board construction shown in FIG. 6 in exaggerated thickness, wherein the cut-outs extend through plies A, B, C and D and the board has a total of 6 plies or 3 layers of double wall of 275 lb. minimum bursting strength. Other preferred characteristics of this construction is that the corrugation of the top plies run transversely to the bottom plies E and F.

For a more comprehensive disclosure of the variations and types of corrugated paperboard which may be used in the present invention, see FIBRE BOX HANDBOOK, 107 pages, 1984 Fibre Box Association, Chicago, Ill., incorporated herein by reference.

Figure 2:
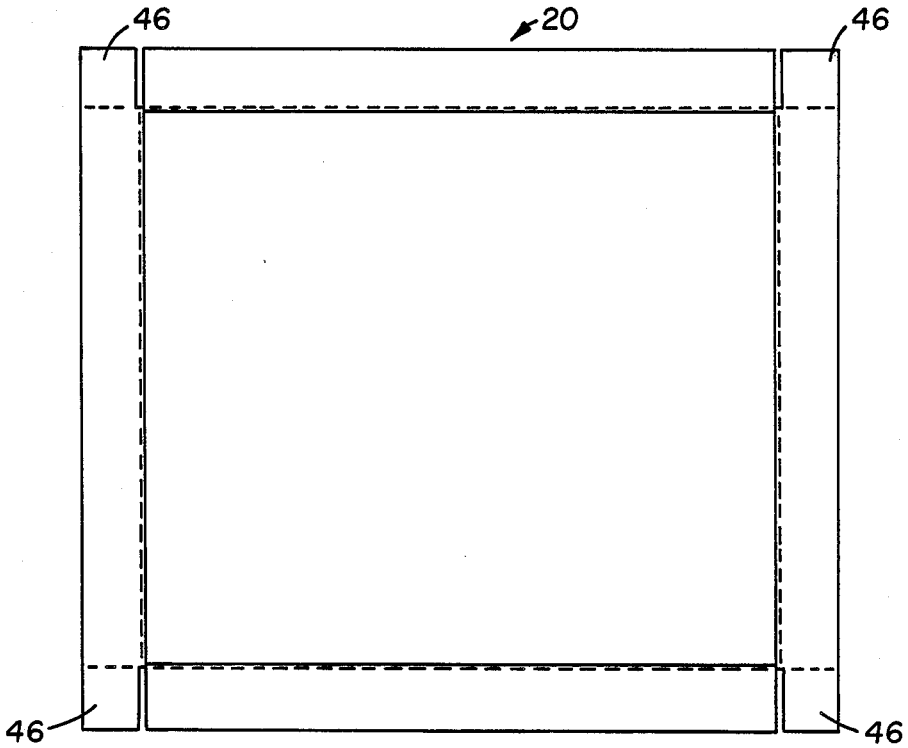
FIG. 2 is an elevational view of the cap blank.
Figure 3:
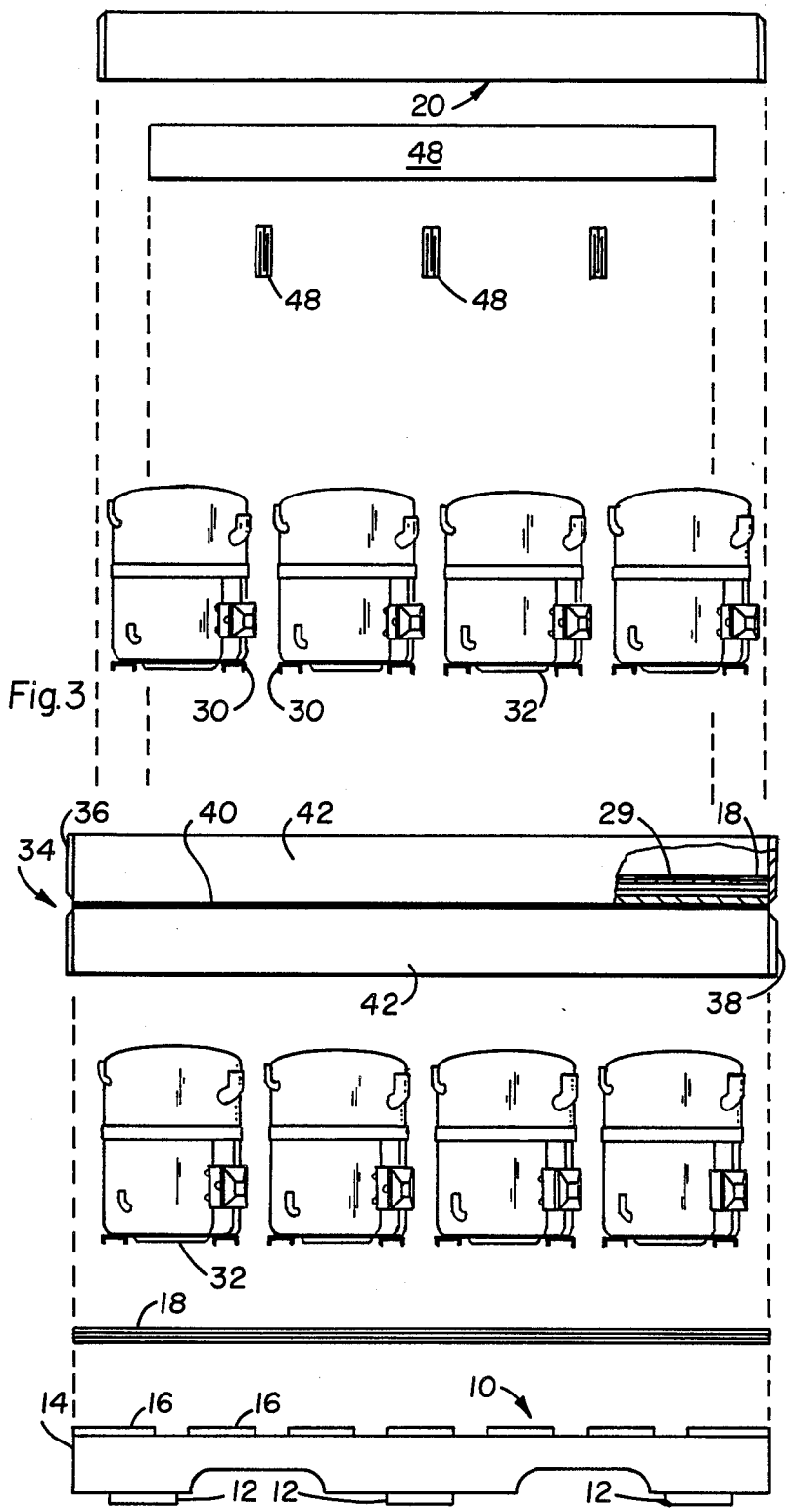
FIG. 3 is an exploded view of the components of the package with a portion of the middle pad assembly shown with a base pad in place in exaggerated dimensions.
Figure 4:
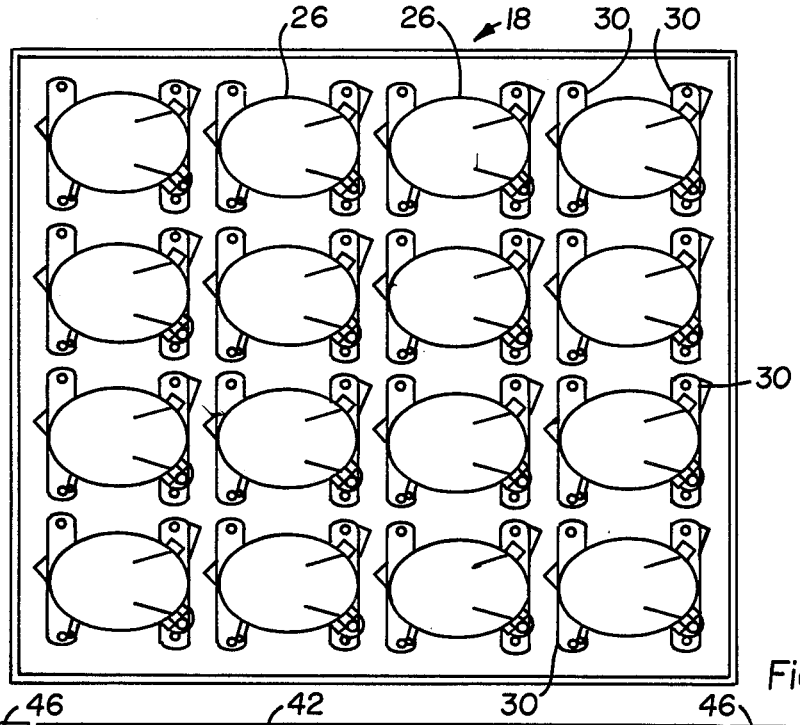
FIG. 4 is a top view of the package with the cap removed to show the compressor vesting pattern.
Figure 5:
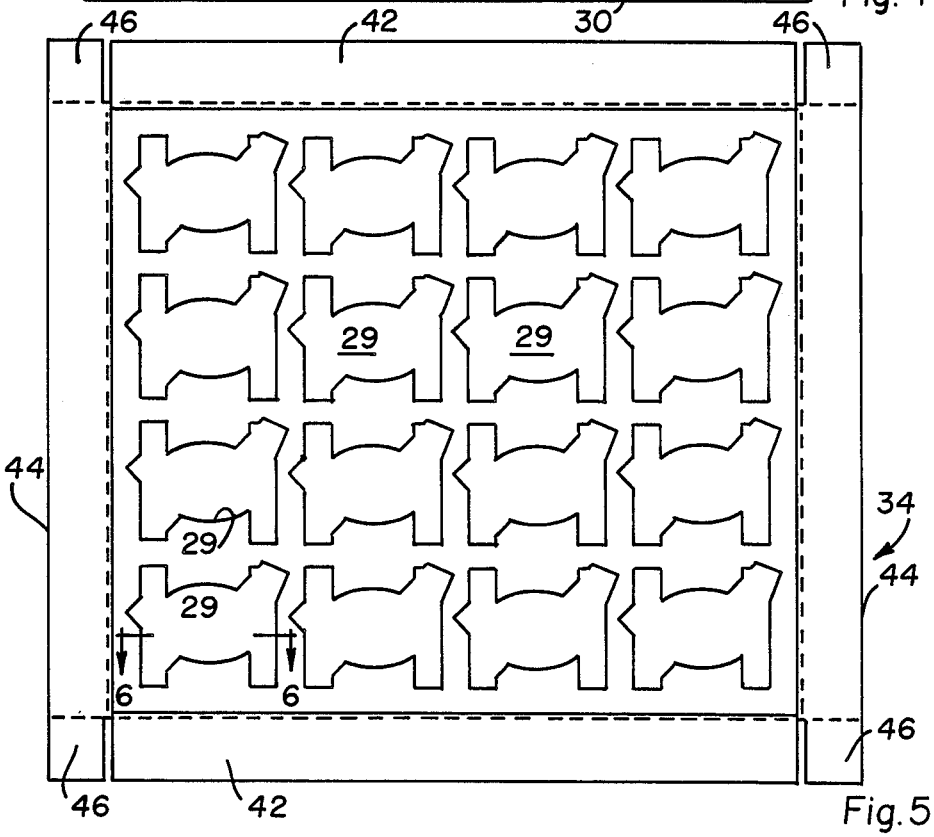
FIG. 5 is an elevational view of the second base pad blank.

The basic structure of the base pad means 18 is also employed for the compressor securing portion of each of the middle pad means 34 which comprises, in a preferred embodiment a pair of back-to-back tray members 36 and 38, the blank configuration for which is shown in FIG. 5 as provided with side walls 42 and end walls 44. These walls are readily foldable downwardly or upwardly with the securing flaps 46 lying inboard or outboard of side walls 42 and fastened thereto by stapling or the like. These tray members are preferably fastened together by adhesive means 40, or stapling or the like, as shown in FIG. 3, however the greatly improved strength of the package derived from their back-to-back assembly is still achieved where no such positive fastening means is employed. The blank configurations for members 36 and 38 may also be employed for the cap 20 as shown in FIG. 2 and allows minimum storage space to be used for the packaging components. Also, the pad 18 may be used in the middle pad means 34 by adhesively affixing it to or simply laying it within the upturned tray member 36 as shown in FIG. 3. It is noted that where the cap 20 construction is the same as that of the tray members, manufacturing, storage and handling costs are greatly reduced. It is noted that for the middle pad means, pad 18 does to have to be as thick as for the base pad since the tray members provide supplemental strength in all directions. Separator cushions 48 such as folded pieces of corrugated board may be interleaved or criss-crossed with the compressors as desired.

Figure 7:
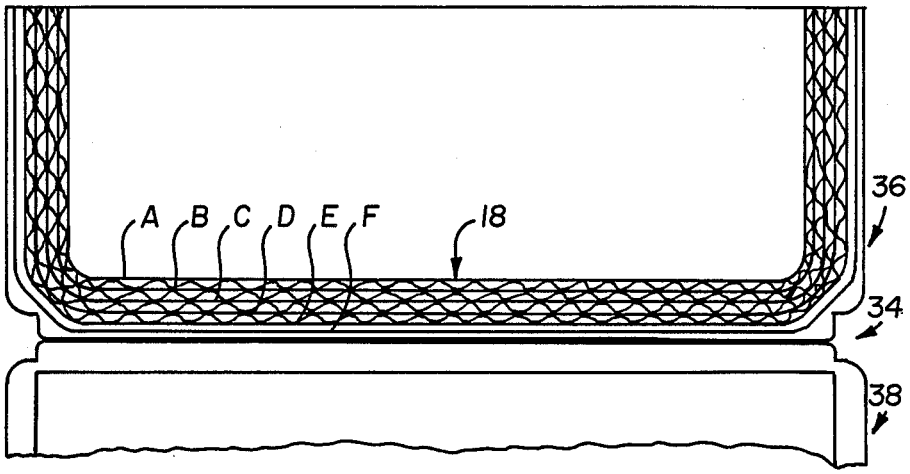
FIG. 7 is a cross-sectional view across the center of a variation of the middle pad shown in enlarged thickness.
Figure 8:
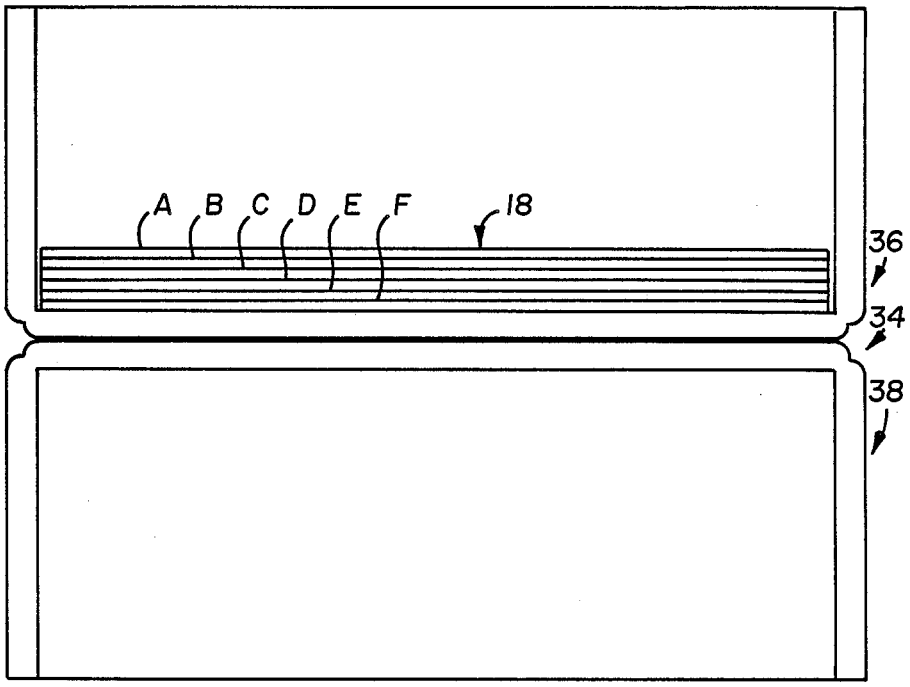
FIG. 8 is a cross-sectional view across the center of another variation of the middle pad shown in enlarged thickness.

Referring to FIGS. 7 and 8, as aforesaid, the package employes a unique pad construction 34 which provides great strength to the package, particularly markedly improved resistance to buckling of the pad upon being struck from the side or corner by lift equipment or the like. In this construction, tray 38 which does not receive the compressor feet does not require as heavy a corrugated construction as tray 36, particularly where, as shown in FIG. 7, the entire blank from which tray 36 is formed is of very heavy corrugated board, e.g., six ply.

Referring to FIG. 8, a preferred construction is for the trays to be identical, and a base pad identical to 18 placed in tray 36. Such construction allows a single preparation and inventory for the trays. These trays, as aforesaid, may also be stapled or adhered together, and in such a manner, their handling and proper placement in the package, on site, is simplified. The thickness and strength of any of these trays or any other portions of the package may be varied depending, e.g., on their application. It is noted that with respect to the preferred embodiment of FIG. 6, the opposite directions of the corrugations of plies A–D with respect to E and F give greatly improved strength of the pads.

The invention has been described in detail with particular reference to preferred embodiments thereof, but it will be understood that variations and modifications will be effected within the spirit and scope of the invention.

I claim:

1. A shipping package for individual product units or the like, adapted for use with a substantially planar shipping pallet, said package comprising base pad means and at least one middle pad means, each of which pad means has a substantially planar corrugated board member having one or more upper and lower plies, at least one of said upper plies having a plurality of individual cut-outs opening at the top surface of said member, each cut-out being shaped to receive lower portions of an individual product unit in a substantially confining manner for preventing lateral movement thereof, each said middle pad means having strengthening wall means peripherally surrounding said board member and oriented normal to the plane thereof, said wall means extending a substantial distance on each side of said plane for maintaining the planar character of said member against substantial distortion forces, a plurality of units positioned on each said pad means in said cut-outs with each said middle pad means positioned on the tops of underlying units, and cap means overlying the uppermost plurality of product units.

2. The package of claim 1 wherein said base pad means is positioned flat on a shipping pallet, and strap means is wrapped around the package and pallet to effect a tightly bound shipping unit comprising said pallet, pad means, product units and cap means.

3. The package of claim 2 wherein said shipping unit is tightly radially, peripherally wrapped with plastic sheeting.

4. The package of claim 1 wherein said cap means is formed of corrugated board having a planar body and strengthening walls integral with and surrounding the periphery thereof and extending downwardly therefrom.

5. The package of claim 1 wherein each said middle pad means comprises an assembly of two equivalent tray structures in back-to-back arrangement, and having an equivalent structure of said base pad means nested in the upper portion of each middle pad means assembly with the cut-outs facing upwardly.

6. The package of claim 1 wherein said base pad means is formed from six ply corrugated board and wherein the bottom two plies run transversely to the upper four plies.

7. The package of claim 6 wherein said cut-outs extend through the upper four plies.

* * * * *